US006334824B1

(12) United States Patent
Filice et al.

(10) Patent No.: US 6,334,824 B1
(45) Date of Patent: Jan. 1, 2002

(54) GOVERNED PERFORMANCE METAL SHELL BAT

(75) Inventors: Gary W. Filice, Van Nuys; Dewey Chauvin, Simi Valley, both of CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 09/525,237

(22) Filed: Mar. 15, 2000

Related U.S. Application Data

(63) Continuation-in-part of application No. 09/375,833, filed on Aug. 16, 1999, now Pat. No. 6,248,032.

(51) Int. Cl.[7] ..... A63B 59/06
(52) U.S. Cl. ..... 473/566
(58) Field of Search ..... 473/564–568

(56) References Cited

U.S. PATENT DOCUMENTS

| | | | | |
|---|---|---|---|---|
| 3,727,295 A | | 4/1973 | Gildemeister | |
| 3,729,196 A | | 4/1973 | Heald, Jr. | |
| 3,735,463 A | * | 5/1973 | Merola | 473/566 |
| 3,801,098 A | | 4/1974 | Gildemeister | |
| 3,854,316 A | * | 12/1974 | Wilson | 473/566 |
| 3,963,239 A | | 6/1976 | Fujii | |
| 5,104,123 A | | 4/1992 | Okitsu | |
| 5,114,144 A | | 5/1992 | Baum | |
| 5,395,108 A | | 3/1995 | Souders et al. | |
| 5,458,330 A | | 10/1995 | Baum | |
| 5,460,369 A | | 10/1995 | Baum | |
| 5,511,777 A | | 4/1996 | McNeely | |
| 5,533,723 A | | 7/1996 | Baum | |
| 5,964,673 A | | 10/1999 | MacKay, Jr. | |

* cited by examiner

*Primary Examiner*—Mark S. Graham
(74) *Attorney, Agent, or Firm*—Roth & Goldman

(57) ABSTRACT

A governed performance metal shell bat designed to ensure ball exit speed approximating and not exceeding that of a wood bat of comparable weight and geometry is comprised of a thin wall metal shell filled such as aluminum or titanium or alloys thereof with light weight semi-rigid material such as a syntactic foam in the hitting area, the bat having longitudinal flexibility approximating that of a similarly shaped wood bat and the filler material having a density and hardness correlated with the thickness of the metal shell wall in the hitting area.

19 Claims, 2 Drawing Sheets

GOVERNED PERFORMANCE METAL SHELL BAT

CROSS-REFERENCE TO RELATED APPLICATIONS, IF ANY

This application is a continuation-in-part of our prior application Ser. No. 09/375,833 filed Aug. 16, 1999 U.S. Pat. No. 6,248,032.

BACKGROUND OF THE INVENTION AND PRIOR ART

1. Field of the Invention

The present invention relates to metal, and more particularly, to aluminum baseball bats which currently are used at the college and lower levels. Such bats typically include a metal shell formed of aluminum or titanium alloy or other metals, such bats being used not only in baseball but also in softball at such substantially all levels of non-professional levels of play. As referred to herein, the terms "aluminum" and "titanium" are intended to encompass the metals and alloys and mixtures of metals and alloys formulated for the manufacture of bat shells.

Recently, the National Collegiate Athletic Association (NCAA) has indicated that, for player safety reasons, the batted ball exit speed for non-wood bats should equate to or not exceed the highest average exit speed using major league baseball quality, 34 inch solid wood bats. Bats meeting these specifications are expected to result in lower incidences of harm to ball players and moderate the game offense.

2. Prior Art

U.S. Pat. No. 5,593,158 issued Jan. 14, 1997 to Filice, et al discloses a hollow aluminum shock attenuating ball bat comprised of essentially two longitudinally extending pieces and a knob and barrel end plug.

U.S. Pat. No. 5,395,108 Souders, et al issued Mar. 7, 1995 for a SIMULATED WOOD COMPOSITE BALL BAT comprises a fiber reinforced composite shell filled with expansible urethane foam to develop compressive stresses therebetween.

U.S. Pat. No. 5,364,095 issued Nov. 15, 1994 to Easton, et al discloses a tubular metal ball bat internally reinforced with fiber composite.

U.S. Pat. No. 5,114,144 issued May 19, 1992 to Baum discloses a composite baseball bat made to look like a wood bat by using a central core of foamed plastic (foam density of 5–15 lbs/cu. ft.) or extruded aluminum covered with a layer of resin impregnated fiber knitted or woven cloth and a surface layer of longitudinally extending planks or strips of resin coated wood veneer.

U.S. Pat. No. 5,460,369 issued Oct. 24, 1995 to Baum discloses a composite bat having a wood veneer surface bonded to a composite tubular core.

U.S. Pat. No. 5,533,723 issued Jul. 9, 1996 to Baum discloses a composite bat having a wood veneer surface and intermediate composite layer bonded to a tubular core of composite or aluminum. The core may comprise a resilient urethane foam and a cavity may be left in the core in the hitting area and the cavity may be filled with less dense material. The core may vary in density over the length of the bat, preferably with a higher density section near the barrel end.

U.S. Pat. No. 5,458,330 issued Oct. 17, 1995 to Baum discloses a composite bat having a wood veneer surface and cavitied foam core.

OBJECT OF THE INVENTION

The primary objective of the invention is to provide a durable metal shell baseball bat in which the ball rebound characteristics approximate those of a wood bat by emulating the longitudinal flexibility and cross sectional rigidity characteristics of a wood bat of similar size and shape whereby the speed of the batted ball is approximately the same as would be experienced with a wood bat of similar weight, shape and size.

SUMMARY OF THE INVENTION

The present invention provides a governed performance metal shell ball bat comprising:

a) a metal shell having a maximum outside diameter in the ball hitting area and a ratio of said maximum outside diameter to the wall thickness of the shell in the hitting area in the range of from 40:1–90:1; and b) a filler substantially filling the interior of the bat shell in the hitting area, said filler having a density in the range of 10–30 lbs./cu. ft. and a hardness on a Shore D test apparatus in the range of 25–65.

The present invention further provides a governed performance aluminum shell ball bat comprising:

a) an aluminum alloy shell having a ratio of maximum outside diameter to the wall thickness of the shell in the ball hitting area in the range of from 45:1–75:1; and b) a foam material substantially filling the interior of the bat shell in the hitting area, said foam having a density in the range of 10–30 lbs./cu. ft. and a hardness on a Shore D test apparatus in the range of 40–65, said bat having longitudinal flexibility characteristics approximating those of a wood bat of identical geometry.

DESCRIPTION OF THE PREFERRED EMBODIMENT

Figure 1:
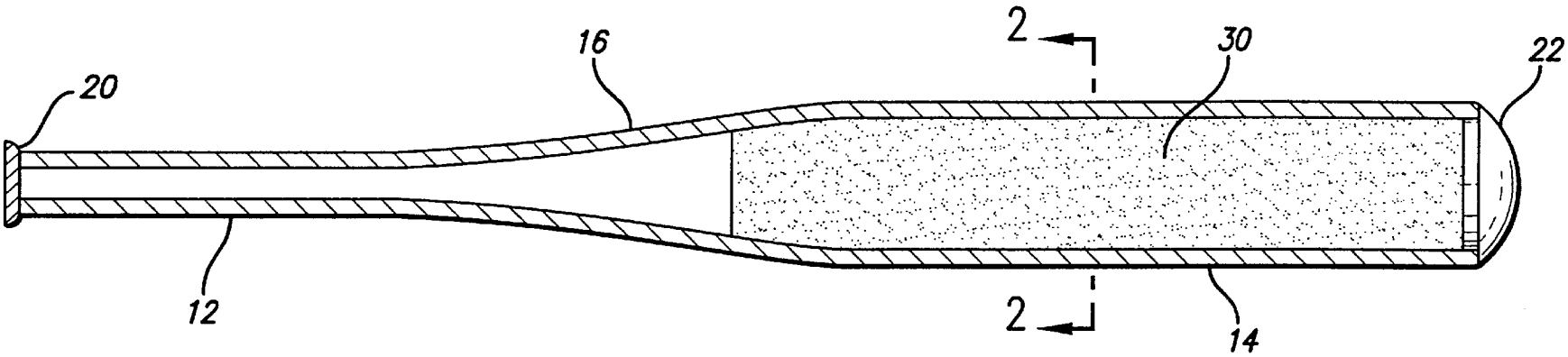
FIG. 1 is a longitudinal cross-section of a bat according to the present invention.
Figure 2:
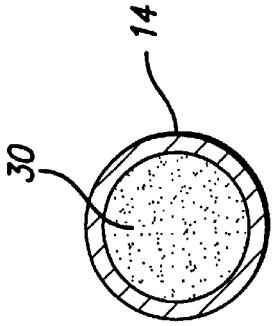
FIG. 2 is a transverse cross-section, taken through the hitting area, of the bat of FIG. 1.

As seen in FIGS. 1 and 2, the baseball bat comprises a metal or metal alloy shell, preferably aluminum, 10 having a handle 12, a barrel 14 and a tapered section 16 interconnecting the handle and the barrel. A knob 20 closes the handle end of the bat and a plug 22 is typically affixed to the barrel end of the bat as is well known. The ball hitting or striking area of the bat generally extends through the full length of the barrel section 14 partially into the tapered section 16 of the bat.

Performance of the bat of the present invention is intentionally designed to match or closely approximate the performance of a typical wood bat of similar weight and geometry by emulating the longitudinal flexibility and cross sectional rigidity of the wood bat. Wood is very flexible in bending, and therefore reduces the effective leverage produced by the batter. At the same time, the high cross sectional rigidity of the solid wood bat produces little, if any, of the so called "trampoline effect" and resulting higher batted ball velocity generated by typical aluminum bats.

Since metals such as aluminum and titanium alloys have a much higher elastic modulus than wood, if a metal shell bat were made with the same approximate outside shape or geometry as a correspondingly shaped wood bat, the metal shell bat would have a substantially higher longitudinal stiffness of as much as, in the case of aluminum alloy, 2.5 to 3.0 times that of the wood bat. Increasing the longitudinal flexibility of the metal shell bat to approximate that of a wood bat requires a great reduction of the wall thickness. A wall thickness reduction to a ratio of bat barrel diameter to wall thickness which accomplishes the desired increase in longitudinal flex, i.e., a ratio found through experimentation to be about 67:1 for an aluminum shell bat, creates another problem since the wall is now thinner than is necessary to stand up to the rigors of the game and results in a barrel which is of inadequate wall strength to repeatedly absorb ball impacts without incurring permanent distortion by denting. Also, substantial thinning of the wall of a metal shell bat, without more, results in undesirable higher ball rebound velocity due to more significant flexing of the bat wall, commonly referred to as "trampoline effect". In comparison, wood bats have a high cross-sectional stiffness which is well able to resist ball impacts and does not generate trampoline effect.

Known prior art composite bats and metal shell bats with resilient walls are intentionally designed to permit localized flexing of the outer bat wall to generate a rebound or trampoline effect following impact with a batted ball to propel the ball with added velocity. Since an objective of the present invention is to govern or reduce the speed of the batted ball to no more than would be experienced with a wood bat, a bat having a reduced bat shell wall thickness to increase longitudinal flex in combination with a semi-rigid low density material which acts as an impact resistant filler in the hitting area to minimize or substantially eliminate the trampoline effect has been developed. In the preferred embodiment, the semi-rigid, low density material is a foam, more specifically a light weight syntactic foam; however, persons skilled in the art will appreciate that a multitude of other materials may be chosen to achieve equivalent results. Without limitation, such materials include packed spheres of light weight materials (e.g., glass or plastic micro-spheres or mixtures thereof), plastic beads (e.g., of propylene, polyethylene and nylon), light weight particulate materials such as flour, corn starch, sand and mixtures thereof; and blown thermoset or thermoplastic foams (e.g. polyurethane, nylon, polystyrene).

The bat of the present invention is preferably comprised of an aluminum alloy shell having an end to end flexibility which approximates that of a correspondingly shaped wood bat and in which the outside diameter of the aluminum alloy barrel 14 has a much thinner wall in the hitting area (generally the barrel 14 and part of the tapered section 16). Typical prior art aluminum shell bats have a handle outside diameter of about 0.880 inches to 0.890 inches and a shell wall thickness of about 0.080 inches to in excess of 0.100 inches. In the present invention when using aluminum alloy for the shell material, the shell has a much thinner wall thickness in the range of about 0.039 inches to 0.055 inches, preferably 0.045 inches to 0.050 inches. If titanium is used for the shell material, the wall thickness must be further reduced to obtain the desired longitudinal flex, i.e., as low as about 0.030 inches.

The ratio of the outside diameter of the barrel 14 to the wall thickness of the shell in the hitting area is in the range of from 40:1–90:1 depending on the alloy used, the preferred range for aluminum alloy being about 45:1 to 75:1 and, for titanium, somewhat higher. In comparison, typical prior art aluminum bats exhibit a ratio of about 20 to 25:1. The relatively thin wall shell 10 is used in conjunction with a semi-rigid (as compared with prior art resilient fillers used to dampen shock) filler 30, which in the preferred embodiment comprises a syntactic foam which substantially fills the interior of the bat shell 10 in the hitting area and results in a longitudinally more flexible metal shell bat which approximates the performance characteristics of a similarly shaped wood bat. Syntactic foam is a plastic non-blown resin foam having bubbles mixed in as by mixing microspheres with the resin components rather than by forming bubbles in the resin during curing of the foaming components.

As previously stated, other materials can be used to provide a relatively lightweight and incompressible filler to provide internal support for the thin wall metallic bat shell. For example a blown foam in which a gas or other blowing agent to blow microbubbles into a thermoplastic or thermoset resin matrix may be used or even a packed particulate material such as flour, corn starch, sand or glass or plastic microspheres. It has been found that a filler material having a density in the range 10–35 lbs./cu. ft. and a hardness, when measured on a Shore-D test apparatus, in the range of 25 to 65 is required to adequately provide internal support for the thin wall aluminum shell 10 described. At the present time, applicant prefers to use a thermosetting resin foam having microspheres mixed therein. The presently preferred foam is di-cyclopentadiene (DCPD) resin. Metallic foam structures are also contemplated.

Figure 3:
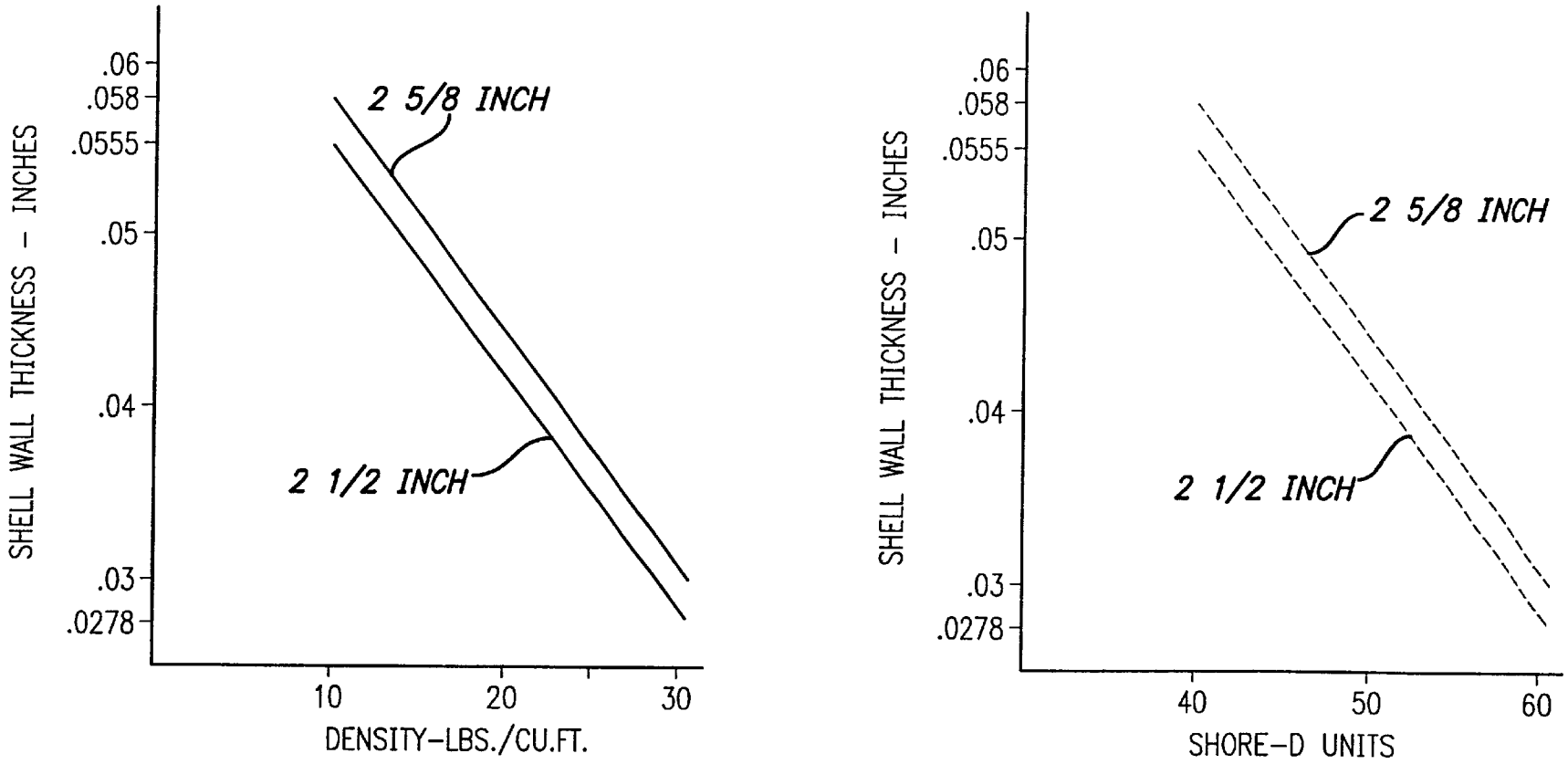
FIG. 3 is a graph illustrating the relationship of various bat parameters including outside diameter in the hitting area, shell wall thickness, density and Shore D hardness of a foam filler.

In order to obtain suitable performance characteristics, which meet the objectives of the invention, the relationship between the characteristics of the foam and the wall thickness of the metal shell, in the hitting area, must be maintained. In general, lower filler densities can be used for thicker shell wall thicknesses without materially affecting the weight of the bat. As the shell wall thickness decreases, a more dense filler is required to maintain proper weight and balance. Also, the filler 30 must be harder to minimize radial displacement of the shell 10 during ball impact. FIG. 3 shows two families of curves respectively relating filler density and hardness to shell wall thickness, one for a bat having 2⅝ inch outside diameter and the second for a bat having a 2½ inch outside diameter. The density curves are shown in solid lines and the hardness curves are shown in dashed lines. The shell wall thickness in inches is shown on the ordinate and the density, expressed in lbs/cu. ft. and the hardness, expressed as Shore-D units, are each shown on the abscissa. Typically, a 2⅝ inch metal shell bat should have a shell wall thickness in the range of from 0.030 inches to about 0.55 inches so that the shell is adequately flexible without becoming too heavy. Persons skilled in the art will recognize that with future advances in Al or Ti strength it may be possible to use thinner walls than those stated here, and that the values stated here represent the presently preferred embodiment based upon material strength available today. For an aluminum shell, the minimum thickness should be not less than 0.039 inches. If a stronger metal such as titanium is used, 0.032 inches appears to be the minimum acceptable workable shell wall thickness to achieve wood like flexibility. Additional alteration of the final wall thickness may be necessary to achieve a fine tuned flexural rigidity and dynamic compressive response comparable to a wood bat depending on the filler material used.

A lower density foam having a density as low as 10 lbs./cu. ft. thus should be used with thicker bat shell walls whereas a more dense foam of as high as 35 lbs./cu. ft. is required when the shell wall thickness is at the lower end of the acceptable range. A thick shell wall of about 0.050 inches for an aluminum shell bat, being relatively heavy, requires a filler density of only about 20 lbs./cu. ft. and has been found to be a marginal combination in resisting denting. A filler hardness of about 40 on a Shore-D test apparatus has been found to be adequate provided the shell wall thickness is near the upper end of the range, e.g., (about 0.050 inches for aluminum) but a harder filler material is required when the thickness of the shell wall in the hitting area decreases. Also shown on the graph are similar curves for a 2½ inch aluminum shell bat which will have correspondingly lower shell wall thickness, foam density and filler hardness.

The filler 30 may be introduced into the metal bat shell 10 in the hitting area in various ways, for example, by pressing in a pre-molded foam core while the foam is still malleable or fully cured, or by transfer molding, injection molding, infusion molding or by pouring uncured resin and hardener components and microspheres together into the bat shell 10 and allowing the resin foam to cure in place. If a foam filler is used, preferably, the foam should have a shrinkage factor of less than 1% during curing to prevent the formation of void spaces between the inner shell wall and foam or internally of the foam itself. Undesired void spaces may be formed during either the filling process or during ordinary use of the bat. To obtain maximum durability, additional attention to complete assembly, e.g., pressing the filler in place, may be required if shrinkage exceeds the desired limit to minimize or eliminate voids.

It should be noted that no adhesive bonding agent between the metal shell 10 and a foam filler 30 such as syntactic foam is necessary or may be desirable, particularly if the foam is injected or poured into the shell and is cured in place since bonding agents may cause degradation of the outer portion of the foam core and since resin foams typically expand during the curing process resulting in significant compressive interengagement between the foam 30 and the shell 10 without the use of an added bonding agent. Also, a metal shell 10 made of aluminum may be heated during the manufacturing process to expand to a diameter greater then nominal, the shell then being allowed to cool and shrink to its intended final diameter as the foam cures, thus generating significant compressive stresses between the shell and foam to hold the foam in place without a separate adhesive bond. The cured foam is characterized by the substantially complete absence of voids or cavities in the foam and between the foam and the bat shell in the hitting area.

It will be appreciated that the heavier the foam and thicker the shell wall, the heavier the bat; and the thinner the bat wall, the greater the necessity for a more dense and hard foam to maintain proper bat weight and balance. Since compressive and shear strength of foams drop as density drops, a very thin metal shell wall requires a more dense and rigid foam. The foam also must not significantly interfere with the desired and designed in longitudinal flex of the shell which must be maintained since aluminum and titanium have a much higher stiffness and density than that of wood.

Longitudinal flexibility characteristics of the bat are matched end to end with those of a wood bat of corresponding weight and geometry preferably by separately determining handle, tapered transition area and barrel flexibilities separately. Each test is performed by supporting the bat at two spaced locations about 15 inches apart. Accordingly, when testing the handle 12 one point of support is adjacent the knob 20 and when testing the barrel, one point of support is adjacent the barrel end of the bat. A vertical load, preferably about 80 pounds, is then applied at the mid-point of the span, i.e., 7.5 inches from either point of support, to ensure that the applied load causes a desired deflection similar to that caused by the same load applied to a wood bat. Test results indicate that the desired deflection in the handle 12 should be in the range of about 0.046–0.055 inches.

Supporting the barrel section 14 of the bat at two spaced locations about 15 inches apart similarly tests the barrel flexibility. A vertical load, preferably about 80 pounds, is then applied to the barrel 14 at the mid-point of the span, i.e., 7.5 inches from either point of support, to ensure that the applied load causes a desired deflection similar to that caused by the same load applied to a wood bat. Test results indicate that the desired deflection in the barrel section should be about 0.0046 inches.

Supporting the bat at two spaced locations about 15 inches apart at either end of the tapered section 16 similarly tests the tapered section longitudinal flexibility. A vertical load, preferably about 80 pounds, is then applied to the tapered section at the mid-point of the span, i.e., 7.5 inches from either point of support, to ensure that the applied load causes a desired deflection similar to that caused by the same load applied to a wood bat. Test results indicate that the desired longitudinal deflection in the tapered section 16 should be about 0.029 inches.

Cross-sectional rigidity tests have also been conducted to determine the amount of radial displacement of the barrel 14 under a transversely applied load. These tests are made by horizontally supporting the barrel in a V-block and applying a vertically directed load of 550 pounds to a one inch square block pressed downwardly against the barrel 14 from above. A wood bat typically exhibits a cross-sectional displacement of 0.020". A typical prior art aluminum bat exhibits a cross-sectional displacement of 0.032". The thin wall bat of the present invention exhibits a comparatively high cross-sectional displacement of 0.104" when unfilled and a cross-sectional displacement after filling (with the preferred syntactic foam) of 0.018"—i.e., substantially the same as the wood bat. A foam filled aluminum shell bat has thus been disclosed which performs substantially the same as a wood bat of generally corresponding geometry.

Persons skilled in the art will appreciate that various modifications of the invention can be made from the above described preferred embodiment and that the scope of protection is limited only by the following claims.

What is claimed is:

1. A governed performance metal shell ball bat comprising:

a) a metal shell having a maximum outside diameter in a ball hitting area and a ratio of said maximum outside diameter to wall thickness of the shell in the hitting area in the range of from 40:1–90:1; and b) a filler substantially filling the bat shell in said hitting area, said filler having a density in the range of 10–30 lbs./cu. ft. and a hardness on a Shore D test apparatus in the range of 25–65.

2. The governed performance bat of claim 1, wherein said filler is a foam material.

3. The governed performance bat of claim 2, characterized by the absence of cavities in said foam material in the hitting area.

4. The governed performance bat of claim 3, wherein said foam material has a shrinkage factor during curing of not greater than 1.0% and characterized by the absence of an adhesive bond between said metal shell and said foam material.

5. The governed performance bat of claim 4, wherein said foam is a thermosetting resin having micro-bubbles mixed therein and a Shore D hardness in the range of 40–65.

6. The governed performance bat of claim 5, wherein said foam is di-cyclopentadiene (DCPD) resin.

7. The governed performance bat of claim 1, wherein said shell is aluminum, said ratio of maximum outside diameter to wall thickness of the shell in the hitting area is in the range of from 45:1 to 75:1 and said shell has a wall thickness in the hitting area in the range of 0.039–0.055 inches.

8. The governed performance bat of claim 7, wherein said filler is a foam material compressively restrained in the shell.

9. The governed performance bat of claim 8, having an outside diameter in the hitting area of about 2⅝ inches and wherein the density of said foam is about 25 pounds per cubic foot and the Shore D hardness of said foam is about 55.

10. A governed performance aluminum shell ball bat comprising:

a) an aluminum alloy shell having a ratio of maximum outside diameter to wall thickness of the shell in a ball hitting area in the range of from 45:1–75:1; and b) a foam material substantially filling the bat shell in said hitting area, said foam having a density in the range of 10–30 lbs./cu. ft. and a hardness on a Shore D test apparatus in the range of 40–65, said bat having longitudinal flexibility characteristics approximating those of a wood bat of identical geometry.

11. The governed performance bat of claim 10, wherein said shell has a wall thickness in the hitting area in the range of 0.039–0.050 inches.

12. The governed performance bat of claim 11, wherein said foam material is a syntactic foam.

13. The governed performance bat of claim 12, wherein said foam is compressively restrained in the shell.

14. The governed performance bat of claim 13, characterized by the absence of cavities in said foam in the hitting area.

15. The governed performance bat of claim 14, wherein said foam has a shrinkage factor during curing of not greater than 1.0%.

16. The governed performance bat of claim 15, characterized by the absence of an adhesive bond between said metal shell and said foam filler material.

17. The governed performance bat of claim 11, having an outside diameter in the hitting area of about 2⅝ inches and wherein the density of said foam is about 25 pounds per cubic foot and the Shore D hardness of said foam is about 55.

18. The governed performance bat of claim 10, wherein said foam is a thermosetting resin having micro-bubbles mixed therein.

19. The governed performance bat of claim 18, wherein said foam is di-cyclopentadiene (DCPD) resin.

* * * * *